United States Patent [19]

Lehtinen

[11] Patent Number: 4,461,095

[45] Date of Patent: Jul. 24, 1984

[54] METHOD OF CONTINUOUS DRYING OF A PAPER OR OTHER POROUS WEB AND A DRYING DEVICE FOR APPLYING THIS METHOD

[75] Inventor: Jukka A. Lehtinen, Tampere, Finland

[73] Assignee: Oy Tampella A.B., Tampere, Finland

[21] Appl. No.: 345,164

[22] Filed: Feb. 2, 1982

[30] Foreign Application Priority Data

Feb. 19, 1981 [FI] Finland ..... 810507

[51] Int. Cl.[3] ..... F26B 3/24

[52] U.S. Cl. ..... 34/41; 34/94; 34/116; 34/119; 34/124

[58] Field of Search ..... 34/6, 9, 41, 71, 94, 34/95, 116, 119, 124

[56] References Cited

U.S. PATENT DOCUMENTS 3,354,035 11/1967 Gottwald et al. ..... 34/41
3,471,363 10/1969 Schmidt ..... 34/116
4,112,586 9/1978 Lehtinen ..... 34/9

*Primary Examiner*—Larry I. Schwartz
*Assistant Examiner*—David W. Westphal
*Attorney, Agent, or Firm*—Ladas & Parry

[57] ABSTRACT

A method of continuous drying of a paper or other porous web by passing the web (3) by means of a drying felt or wire (4) between two moving, air-impermeable surface elements (1, 8) having good heat conducting properties, which elements enclose the web along its whole width. The surface element (1) contacting the web is heated and the surface element (8) contacting the wire is cooled for evaporating water present in the web and condensing the evaporated water into the felt or wire. The temperature of the liquid used for cooling the surface element to be cooled is maintained above 100° C. and the pressure at least at such a level as to prevent the liquid from boiling. Thus, the drying of the web can be carried out at an elevated temperature and under an elevated pressure in a continuous process at production conditions for improving the web characteristics.

Preferably the cooling liquid is maintained at different temperatures and/or under different pressures at separate steps of the cooling process. Thus, it is possible to adjust the drying conditions affecting the web characteristics.

The device for carrying out the method is provided with a cooling space (11) divided into at least two separate cooling liquid compartments positioned one after the other in the direction of movement of the surface elements (1, 8), said compartments containing cooling liquids having different temperatures and/or pressures, the temperature of at least one cooling liquid being above 100° C.

8 Claims, 3 Drawing Figures

METHOD OF CONTINUOUS DRYING OF A PAPER OR OTHER POROUS WEB AND A DRYING DEVICE FOR APPLYING THIS METHOD

This invention relates to a method of continuous drying of a paper, cardboard or other porous web, according to which method a web and a drying felt or wire supporting said web are subjected to an air removal treatment the web and the drying felt or wire are passed between two moving, airimpermeable surface elements having good heat conducting properties, which elements enclose the web along its whole width, the surface element contacting the web is subjected to heating and the surface element contacting the drying felt or wire is subjected to cooling by a liquid, in order to condense water evaporating from the web into the drying felt or wire, the drying felt or wire is separated from the dry web after leaving said surface elements and the condensed water is removed from the drying felt or wire.

Such a method and devices for carrying out said method are described for instance in Finnish Pat. Nos. 55 514 and 55 539, and in Austrian Pat. No. 358 916. The drying takes place by means of heat passing from a hot surface into the wet web. Correspondingly, water evaporates in the web. The water steam passes through the web and through the gaspermeable felt or wire and condenses into water on the surface of the cold band. The released latent heat passes into the cold band. In order to obtain continuous drying, the hot surface has to be heated continuously, e.g. by means of externally condensing steam, and the cold band has to be cooled continuously, e.g. by means of external cooling water. The pressure of the steam when condensing on the cold band is thus determined by the temperature of this band. For instance, in Finnish Pat. No. 55 539 and the Austrian Pat. No. 358 916, the temperature of the cold band is maintained at about 10°-40° C., whereby the steam condenses on the cold band at a pressure of 0.01-0.12 bar. If a pressure of 1.0 bar prevails outside the cold band, the web is pressed against the hot surface only with a pressure of 0.88-0.99. If the temperature of the hot surface is 170° C., the surface of the web to be dried contacting the hot surface is at a temperature approximately 170° C., while the opposite surface of the web to be dried is at a much lower temperature of 40°-60° C.

It is known from laboratory test and other investigations that the drying of paper and cardboard at a high temperature and under a high pressure (so called press drying) causes great alterations in the characteristics of the dried web, compared with a web which has been dried for instance by a conventional cylinder dryer. Tests have been performed both by drying wet laboratory sheets under pressure for short durations, typically 0.005-0.2 seconds, successively in a press roll nip whereby the pressure is typically as high as 3 MPa and the temperature of the metal surface contacting the web is 150°-350° C., and by press drying in a single continuous pressing operation whereby the pressing time varies between 0-60 seconds and the pressure and the temperature are as described above. Press drying appears, particularly in connection with a high temperature, to increase the density and it also increases the tensile strength as well as the elastic modulus of the web if the density remains the same. The maximum effect of press drying in increasing the tensile strength seems to occur at a dry solids content of 30-65%, where the interfiber bonds in the web are forming. With high yield stocks the strength increase is particularly noticeable.

It has been observed that the above described effect of press drying on the characteristics of the dried web results from the fact that during press drying the hemicelluloses in the fibers "melt" or soften in the presence of water relatively easily, causing stronger fiber to fiber bonds, and consequently, improved strength characteristics of the dried web. The lignin in the fibers melts more slowly, however, but in a molten state the lignin generates hydrophobic bonds which protect hydrophilic hemicellulose bonds formed earlier. In a dry state, hemicellulose bonds are much stronger than lignin bonds but moisture softens easily the former but not the latter. If lignin is not allowed to melt, a web with especially good strength characteristics, e.g. creep strength, in a dry state, but with poor characteristics in a wet state can be produced by press drying. If, on the contrary, ligning melting has not taken place, the creep strength of the web may be a little lower, but the web is much more resistant to moisture, and especially to successive fluctuations of the moisture level, because the molten lignin protects the hemicellulose bonds which have been formed earlier.

Two types of devices have been used on a laboratory scale.

In the first type the web alone or provided with a felt or wire on one side is impacted by means of a pendulum against a hot surface. When the pendulum bounces back, the web separates from the hot surface. In the device of the second type, the wet web alone or provided with a felt or wire on one side is pressed between two heated plates in a plane press.

It is clear that neither of these methods for press drying on a laboratory scale can be developed into a press drying method for full-size, fast production machines operating continuously. It has been considered possible to alter a press providing a press nip between conventional rolls so that the roll contacting the webs heated from inside, e.g. by condensing steam or hot oil. In practice this method would, however, suffer from the drawback that the web passes through the press nip in about 1-5 milliseconds.

Though in press drying conditions the drying rate is very high, the web cannot be thoroughly heated to the desired temperature of more than 100° C. during such a short time. Between the nips the web cools again if it is not surrounded by steam.

The purpose of this invention is to obtain a method which eliminates the above-mentioned disadvantages and allows press drying to be carried out as a continuous process under production conditions. This purpose is achieved according to the invention by means of a method characterized in that the temperature of the liquid used for cooling the cooled surface is maintained at least during a part of the cooling step above 100° C. and the pressure at least at such a level that the liquid is prevented from boiling. By means of the method according to the invention desirable characteristics caused by press drying can be obtained in a web dried in a single pass during a normal web manufacturing process.

While press drying the web, it is possible within certain limits to adjust the characteristics of the web from a high creep strength and a wet strength towards a lower creep strength and a higher wet strength, by controlling the extent of ligning melting during the drying process. The longer the web remains at a very high temperature during the press drying, the more lignin melts and, correspondingly, the further the characteristics of the web are adjusted towards lower creep strength and higher wet strength.

Often it is desirable that the web thickness or bulk is decreased as little as possible during the drying. Therefore the pressure of the cooling water should be held as low as possible during the later stages of drying, when bonds are no longer formed between the fibres.

In order to control the characteristics of the web, it is advantageous, according to one mode of application of the drying method according to the invention, to carry out the cooling in separate steps and to maintain the cooling liquid at different temperatures and/or pressures in such successive cooling steps.

If water is used as cooling liquid, the pressure of the cooling water must be maintained above the boiling point because the pressure at which the water which has evaporated from the web condenses on the cooled band is depending of the temperature of the band surface. The temperature of this surface is somewhat higher than that of the cooling water, because the latent heat which is released during the condensation has to move through the band to the cooling water. Thus the water evaporated from the web condenses on the cooled band at a pressure which is higher than the saturation pressure of the cooling water. If the pressure of the cooling water is as low as the saturation pressure, the cooled band will be displaced by the higher pressure of the condensed water. For this reason the pressure of the cooling water must be above the saturation pressure.

The gaspermeable felt or wire is pressed against the web to be dried almost with a pressure which is the pressure difference between the cooling water and the condensing steam. The pressure against the web would amount exactly to said pressure difference, if the steam from the web would not lose some pressure when passing through the felt or wire. This pressure loss is, however, small—especially when the pressure of the steam is high and its specific volume is small.

If the pressure of the cooling water is increased to a higher pressure than is necessary to prevent the cooled band from being displaced, the pressure caused by the felt or wire on the web correspondingly increases.

In order to reach a sufficiently high pressing effect, the pressure of the cooling liquid must be between 1–30 bar. According to one advantageous mode of application of the method, water at a temperature of 105° C. and under a pressure of 4 bar is used for cooling the cooled surface.

The invention relates also to a drying device for carrying out the method according to the invention and this device is characterized by the features according to claim 5. A drying device known per se can be changed by simple means to be suitable for continuous press drying at production conditions.

The invention is described in more details in the following with reference to the enclosed drawings.

Figure 1:
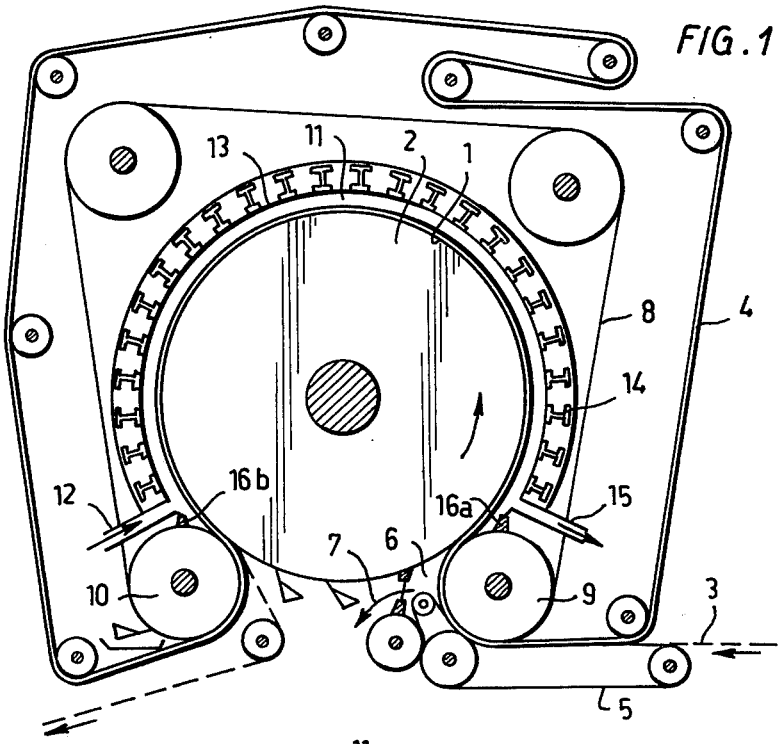
FIG. 1 is a schematical side view of an embodiment of a drying device according to the invention as a cylinder dryer with single stage cooling.

In the drying device according to FIG. 1 a hot surface element 1 is formed by the outer metal surface of a cylinder 2, which is heated from the inside. A web 3 to be dried passes between a gaspermeable felt or wire 4 and an auxiliary wire 5 into an air removal chamber 6, from which air 7 is continuously sucked by means of a suction pump. The web 3 passes between the hot surface element 1 of the cylinder 2 and the felt or wire 4 to a drying zone which starts from the nip between the cylinder 2 and a turning roll 9 for a liquid impermeable metal band 8, and continues to the nip between the cylinder 2 and a second turning roll 10. Consequently, in the drying zone the web 3 to be dried, the felt or wire 4, and the metal band 8 are positioned on top of each other upon the hot surface element 1. Outside the metal band 8 there is a pressure-tight cooling space 11, wherein pressurized cooling water flows. This water flows through a conduit 12 into a hood 13 surrounding the drying zone of the cylinder. The hood is made strong enough, for instance by means of supporting beams, to withhold the pressure of the cooling water. The hood 13 is also thermally insulated on its outer surfaces. The warmed cooling water leaves the hood through a conduit 15.

The cooling space 11 is sealed by means of suitable seals **16*a* and 16*b* against the rolls 9 and 10, respectively. On both sides of the machine the cooling space 11 under the hood 13 must also be sealed either against the metal band 8 or the outer surface of the cylinder 2**.

The surface 1 of the cylinder is heated by means of saturated steam supplied into the cylinder. The temperature of the steam is, for instance, 170° C., and the pressure 7.9 bar.

The cooling water at a temperature of, for instance, 105° C. and under a pressure of 4 bar is supplied into the cooling space 11. It is noted that the web 3 passing from the nip between the cylinder and the inlet turning roll 9 top the nip between the cylinder and the outlet turning roll 10, is subjected by the metal band to a pressing effect caused by the cooling water. Consequently the web at the same time presses onto the hot cylinder surface 1. Due to the temperature difference between the surface 1 and the metal band 8, water evaporating from the web passes through the felt or the wire and condenses on the surface of the metal band. Due to the elevated temperature and pressure of the cooling water, the drying of the web takes place at an elevated temperature and under an elevated pressure, whereby changes typical of press drying, as described above, toward an improved tensile strength and/or wet strength, take place in the characteristics of the web.

Figure 2:
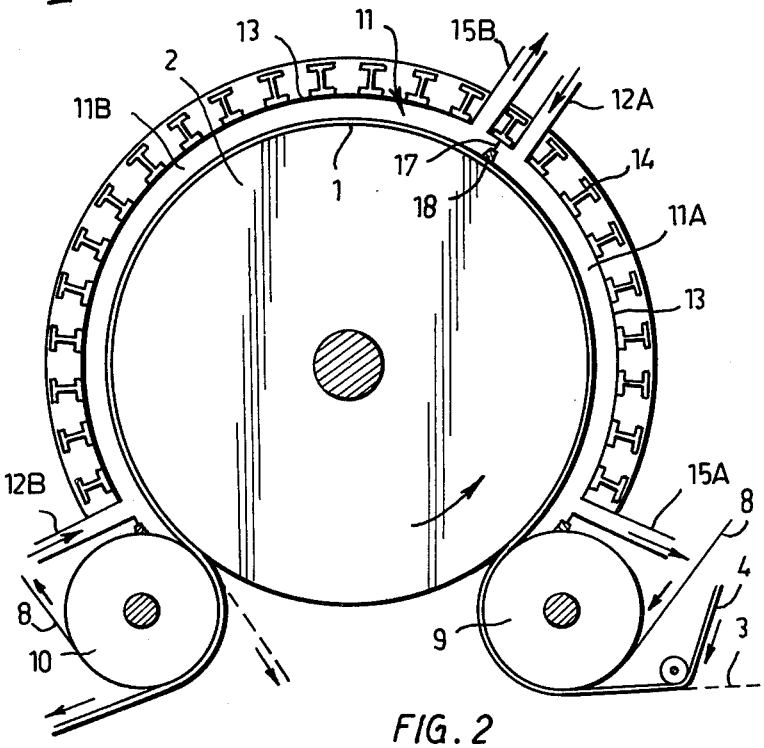
FIG. 2 is a similar view illustrating the same cylinder dryer with multi-stage cooling.

The drying device described in FIG. 2 differs from the above-mentioned embodiment only in that instead of continuous cooling, cooling takes place in two stages. Thus the cooling space 11 illustrated in FIG. 1, has been divided by means of two separation walls 17 and seals 18 into two separate cooling compartments 11 A and 11 B in the direction of movement of the web.

Inlet conduits 12 A and 12 B and outlet conduits 15 A and 15 B, respectively, have been provided for each compartment. Cooling water at different temperatures and/or pressures is supplied into the separate cooling compartments. By means of such a construction, it is possible to maintain different temperature and/or pressure conditions on the cooling side of the device during drying. The tempetature of the cooling water must be at least in one cooling stage above 100° C. and the pressure must be high enough to prevent the water from boiling in the cooling space. It is observed that the pressure of the cooling water may be maintained at the end of the drying lower than at the beginning of the drying, so that the web thickness will be decreased as little as possible, yet achieving several advantages of press drying.

The cooling space 11 under the hood 13 can be divided into several separate compartments. The cooling water can be fed into each compartment under a a different pressure and at a different temperature. With such an arrangement it is advantageous that the temperature of the cooling liquid is maintained at least in one compartment at a temperature above 100° C. whereby the pressure in that compartment is at least at such a level as to prevent the liquid from boiling, and the temperature of the cooling liquid is maintained at least in one preceding or following compartment below 100° C.

Figure 3:
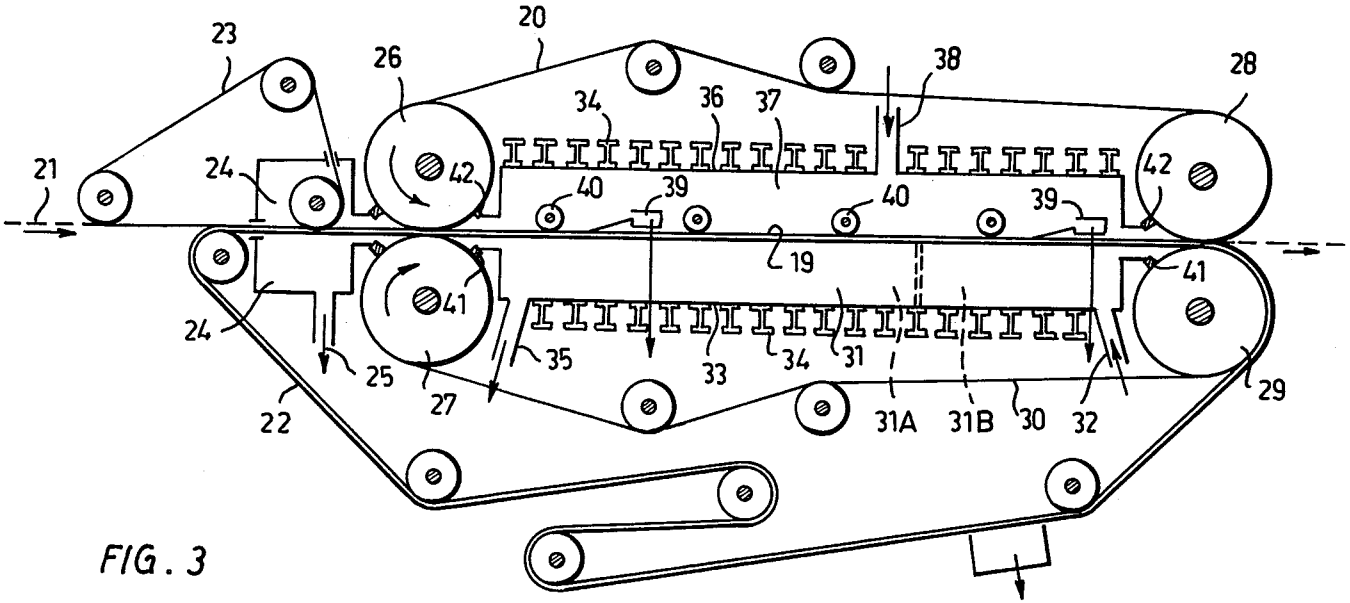
FIG. 3 is a side view of a drying device according to the invention as a horizontal arrangement with parallel bands.

In the drying device according to FIG. 3 a hot surface element 19 is formed by the surface of a moving metal band 20, which is heated from one side. A web 21 to be dried passes between a gaspermeable felt or wire 22 and an auxiliary wire 23 to an air removal chamber 24, wherefrom air 25 is continuously sucked by means of a suction pump. The web passes between the metal band and the felt or wire to a drying zone, which starts from the nip between turning rolls 26 and 27, and continues to the nip between turning rolls 28 and 29. In the drying zone the hot metal band 20, the web 21, the felt or wire 22 and an impermeable metal band 30 are positioned one under the other. Under the metal band 30 there is a liquid impermeable, pressure-tight cooling space 31, wherein pressurized cooling water flows. This water is supplied through a conduit 32 into a cooling chest 33 extending all along the drying zone. The cooling chest is made strong enough, for instance by means of supporting beams 34, to withhold the pressure of the cooling water. The cooling chest is thermally insulated on its outer surfaces. The warmed cooling water leaves the cooling chest through a conduit 35.

The metal band 20 is heated along the whole length of the drying zone by pressurized steam in a heating space 37 enclosed by a steam chest 36 above the metal band. Steam is supplied through a conduit 38 and condenses on the surface of the metal band 20.

The latent heat passes through the metal band 20 into the web to be dried. The condensate which is formed is removed from the steam chest by means of suitable condensate removal elements 39. The pressure of the steam supplied into the steam chest must be maintained at a level very close to the pressure of the water brought into the cooling chest, so as to keep the forces caused by the pressures of the steam and the cooling water on the web, felts and bands 20, 21, 22, 30 in the drying zone in balance.

For obtaining the best operating results it may be advisable to maintain the steam pressure in the steam chest at a somewhat lower level than the pressure of the cooling water and to guide the sandwiched web, felts and bands to pass over supporting rolls 40. The cooling chest is sealed by seals 41 against the rolls 27 and 29. Likewise, the steam chest is sealed by seals 42 against the rolls 26 and 28. The cooling chest as well as the steam chest are also sealed on both sides of the machine.

In this embodiment the web is also subjected to press drying, since the web is during the entire drying process at a temperature above 100° C. and under such a high pressure that boiling of the cooling water is prevented. By suitable adjustment of the temperatures of the heating steam and the cooling water, it is nevertheless possible to cause the moisture to evaporate from the web.

Also in the device according to FIG. 3 the cooling space 31 can be divided into several separate compartments 31 A and 31 B. Each compartment may be supplied with cooling liquid under different pressures and at different temperatures. Such compartmentizing is indicated by broken lines in FIG. 3. With such an arrangement it is necessary to have corresponding counterforces on the steam side of the bands.

The drawings and the description relating thereto are only intended to illustrate the principle of the invention. In its details the method according to the invention may vary within the scope of the claims.

I claim:

1. A method of continuous drying of a paper, cardboard, or other porous web, according to which method a web (3; 21) and a drying felt or wire (4; 22) supporting said web are subjected to an air removal treatment, the drying felt or wire are passed between two moving, air impermeable surface elements (1, 8; 20, 30) having good heat conducting properties, which elements enclose the web along its whole width, the surface element (1; 20) contacting the web is subjected to heating and the surface element (8; 30) contacting the drying felt or wire is subjected to cooling by a liquid, in order to condense water evaporating from the web into the drying felt or wire, the drying felt or wire is separated from the dry web after leaving said surface elements and the condensed water is removed from the drying felt or wire, characterized in that the temperature of the liquid used for cooling the cooled surface (8; 30) is at least during a part of the cooling maintained above 100° C. and the pressure at least at such a level that the liquid is prevented from boiling.

2. A method according to claim 1, the improvement being, that the cooling is carried out in separate steps and that the cooling liquid is maintained at different temperatures and/or under different pressures in such successive cooling steps.

3. A method according to claim 2, the improvement being, that the temperature of the cooling liquid is maintained above 100° C. and the pressure at least so high as to prevent the liquid from boiling in at least one cooling step and that the temperature of the cooling liquid is maintained below 100° C. in at least one subsequent cooling step.

4. A method according to claim 2, the improvement being, that the temperature of the cooling liquid is maintained below 100° C. in at least one cooling step and that the temperature of the cooling liquid is maintained above 100° C. and the pressure at least at such a level as to prevent the liquid from boiling in at least one subsequent cooling step.

5. A method according to claim 1 or 2, the improvement being, that the pressure of the cooling liquid is maintained between 1–30 bar.

6. A method according to claim 1, the improvement being, that water having a temperature of about 105° C. and a pressure of about 4 bar is used as the cooling liquid.

7. An apparatus for continuous drying of a porous web comprising a drying felt or wire (4; 22) for transporting a web (3; 21) to be dried, an air removal chamber (7; 24) for removing air from the web and from the drying felt or wire, two endless, airimpermeable, moving surface elements (1, 8; 20, 30) having good heat conducting properties, which elements over a part of their direction of movement run parallel with each other in the same direction and enclose the web and the drying felt or wire from opposite sides between and into contact with said surface elements, and a heating space (2; 37) positioned adjacent the surface element (1; 20) contacting the web, said heating space containing a medium for heating of said surface element, and a cooling space (11; 31) positioned adjacent the surface element (8; 30) contacting the drying felt or wire, said cooling space containing a cooling liquid for cooling of said surface element along said parallel part of the path of movement of said elements, the improvement being, that the cooling space (11; 31) is divided into at least two separate compartments (11 A, 11 B; 31 A, 31 B) positioned one after the other in the direction of movement of the surface elements, said compartments containing cooling liquids of differing temperatures and/or pressures, the temperature of at least one of said liquids being above 100° C.

8. A device according to claim 7, the improvement being, that said separate compartments (11 A, 11 B; 31 A, 31 B) of said cooling space (11; 31) are pressure-tight.

* * * * *